US007074533B2

(12) United States Patent
Fuller et al.

(10) Patent No.: US 7,074,533 B2
(45) **Date of Patent: *Jul. 11, 2006**

(54) PHOTOCONDUCTIVE MEMBERS

(75) Inventors: Timothy J. Fuller, Pittsford, NY (US); Satchidanand Mishra, Webster, NY (US); John F. Yanus, Webster, NY (US); Anthony M. Horgan, Pittsford, NY (US); Geoffrey M. T. Foley, Fairport, NY (US); Huoy-Jen Yuh, Pittsford, NY (US); Dale S. Renfer, Webster, NY (US); Yuhua Tong, Webster, NY (US); Kenny-Tuan T. Dinh, Webster, NY (US); Markus R. Silvestri, Fairport, NY (US); John F. Graham, Oakville (CA)

(73) Assignee: Xerox Corporation, Stamford, CT (US)

( * ) Notice: Subject to any disclaimer, the term of this patent is extended or adjusted under 35 U.S.C. 154(b) by 3 days.

This patent is subject to a terminal disclaimer.

(21) Appl. No.: 11/090,531

(22) Filed: Mar. 25, 2005

(65) Prior Publication Data

US 2005/0170273 A1 Aug. 4, 2005

Related U.S. Application Data

(62) Division of application No. 10/429,550, filed on May 5, 2003, now Pat. No. 6,919,154.

(51) Int. Cl.
*G03G 5/147* (2006.01)

(52) U.S. Cl. ..... 430/58.8; 430/59.4; 430/66

(58) Field of Classification Search ..... 430/66, 430/67, 58.8, 59.4
See application file for complete search history.

(56) References Cited

U.S. PATENT DOCUMENTS

| | | | | |
|---|---|---|---|---|
| 4,265,990 | A | 5/1981 | Stolka et al. | 430/59 |
| 4,362,798 | A | 12/1982 | Anderson et al. | 430/59 |
| 4,555,463 | A | 11/1985 | Hor et al. | 430/59 |
| 4,587,189 | A | 5/1986 | Hor et al. | 430/59 |
| 5,473,064 | A | 12/1995 | Mayo et al. | 540/141 |
| 5,482,811 | A | 1/1996 | Keoshkerian et al. | 430/135 |
| 5,521,306 | A | 5/1996 | Burt et al. | 540/141 |
| 5,756,245 | A | 5/1998 | Esteghamatian et al. | 430/59 |
| 6,004,708 | A | 12/1999 | Bellino et al. | 430/58.45 |
| 6,080,518 | A | 6/2000 | Levin et al. | 430/58.4 |
| 6,171,741 | B1 | 1/2001 | Evans et al. | 430/58.35 |
| 6,919,154 | B1 * | 7/2005 | Fuller et al. | 430/58.8 |

FOREIGN PATENT DOCUMENTS

| | | |
|---|---|---|
| JP | 58 163946 | 9/1983 |

* cited by examiner

*Primary Examiner*—John L Goodrow
(74) *Attorney, Agent, or Firm*—E. O. Palazzo

(57) ABSTRACT

A photoconductive imaging member containing a supporting substrate, a photogenerating layer, a charge transport layer, and in contact with the charge transport layer a layer comprised of a polymer and a yellow dye of the formula

20 Claims, No Drawings

PHOTOCONDUCTIVE MEMBERS

This is a divisional of U.S. application Ser. No. 10/429,550 filed May 5, 2003, now U.S. Pat. No. 6,919,154 issued Jul. 19, 2005, by the same inventors, and claims priority therefrom.

RELATED PATENTS

Illustrated in U.S. Pat. No. 6,713,220 on Photoconductive Members, the disclosure of which is totally incorporated herein by reference, is a photoconductive imaging member comprised of a supporting substrate, a photogenerating layer and a charge transport layer, and wherein the charge transport layer contains a component that substantially prevents light of a wavelength of about equal to or about less than 700 nanometers from interaction with the photogenerating layer.

Illustrated in U.S. Pat. No. 5,756,245, the disclosure of which is totally incorporated herein by reference, is a photoconductive imaging member comprised of a hydroxygallium phthalocyanine photogenerator layer, a charge transport layer, a barrier layer, a photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, and thereover a charge transport layer.

Illustrated in U.S. Pat. No. 5,521,306, the disclosure of which is totally incorporated herein by reference, is a process for preparation of Type V hydroxygallium phthalocyanine comprising the in situ formation of an alkoxybridged gallium phthalocyanine dimer, hydrolyzing the dimer to hydroxygallium phthalocyanine and subsequently converting the hydroxygallium phthalocyanine product to Type V hydroxygallium phthalocyanine.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above recited patents may be selected for the present invention in embodiments thereof.

BACKGROUND

This invention is generally directed to imaging members, and more specifically, the present invention is directed to photoconductive imaging members with, for example, improved resistance to light shock and methods of using the imaging member. Light shock refers, for example, to a phenomena in which a photoresponsive imaging member when exposed to room light exhibits an increase in dark decay, increased sensitivity, collapse of the photoinduced discharge curve (PIDC) tail, reduced residual potential $V_{residual}$, and generally adverse changes in the electrical response properties on exposure to light, and during repeating cycles of charge, exposure, and erasure, especially when the photogenerating pigment is a hydroxygallium phthalocyanine. The exposure to room light may occur, for example, during installation of the photoreceptor or during servicing of a machine, such as a xerographic machine. Thus, for example, during belt replacement or machine maintenance, nonuniform exposure of a photoreceptor to room light can result in nonuniformity in the electrical properties of the imaging member. A difference in electrical properties between exposed areas of an imaging member is undesirable because it can cause nonuniform image potentials which in turn results in the formation of nonuniform and unacceptable in many instances toner images when the light shocked imaging member is subsequently utilized for electrophotographic imaging. More specifically, the present invention relates to imaging members containing a dye, such as a yellow dye in an overcoating layer, and wherein the charge generation layer is resistant to or there is an avoidance of light shock thereof, especially at from about 400 to about 500 nanometers of light, and which light can adversely affect the photogenerating pigments present in the charge generating layer. In embodiments, the dye dopant or additive component in the overcoat layer absorbs light of wavelength less than about 700 nanometers, and more specifically, shorter than about 460 nanometers; and also wherein the dye component present in the overcoat layer is a yellow dye of, for example, the formula illustrated herein and which overcoat is comprised of a LUCKAMIDE®, a commercially available polymer, and which overcoating will prevent or minimize any light with a wavelength of about 400 nanometers to about 460 nanometers from interacting with the photogenerating layer. Examples of photogenerating pigments include hydroxygallium phthalocyanines, such as Type V hydroxygallium phthalocyanine. Processes of imaging, especially xerographic imaging, and printing, including digital, are also encompassed by the present invention.

Additionally, more specifically, the layered photoconductive imaging members of the present invention can be selected for a number of different known imaging and printing processes including, for example, multicopy/fax devices, electrophotographic imaging processes, especially xerographic imaging and printing processes wherein negatively charged or positively charged images are rendered visible with toner compositions of an appropriate charge polarity. The imaging members are in embodiments sensitive in the wavelength region of, for example, from about 400 to about 900 nanometers, and in particular, from about 550 to about 830 nanometers, thus IR diode lasers can be selected as the light source. Moreover, the imaging members of the present invention in embodiments can be selected for color xerographic imaging applications where several color printings can be achieved in a single pass.

REFERENCES

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene pigment photogenerating component. Both of the aforementioned patents disclose an aryl amine component as a hole transport layer.

Illustrated in U.S. Pat. No. 6,171,741, the disclosure of which is totally incorporated herein by reference, is an electrophotographic imaging member containing in the charge transport layer a light shock resisting additive of triethanolamine, morpholine, an imidazole or mixtures thereof. Illustrated in U.S. Pat. No. 4,362,798, the disclosure of which is totally incorporated herein by reference, is a process for electrophotographic reproduction, and a layered electrophotographic member with a charge generation layer, p-type hydrazone containing charge transport layer, and wherein the charge transport can contain components, such as DEASP.

Illustrated in U.S. Pat. No. 6,004,708, the disclosure of which is totally incorporated herein by reference, is a photoconductor which exhibits reduced room light and cycling fatigue, and containing a fluorenyl-azine derivative in the charge transport layer.

Illustrated in U.S. Pat. No. 6,080,518, the disclosure of which is totally incorporated herein by reference, is a photoconductor containing quinone additives in either the charge generation layer, the charge transport layer, or both.

The appropriate components and processes of the above patents may be selected for the present invention in embodiments thereof.

SUMMARY

It is a feature of the present invention to provide imaging members thereof with many of the advantages illustrated herein.

Another feature of the present invention relates to the provision of layered photoresponsive imaging members with excellent photosensitivity to near infrared radiations, and wherein light wavelengths emitted in the visible region are absorbed in the overcoating layer and prevented from interacting with, or entering into, in embodiments, the photogenerating layer.

Yet another feature of the present invention relates to the provision of layered photoresponsive imaging members with excellent photosensitivity to near infrared radiations, and wherein light wavelengths emitted in the blue region are absorbed in the overcoating layer containing certain yellow dyes, and which light is substantially prevented from interacting with the photogenerating layer. Blue light is the primary cause of light shock, which refers, for example, to a change in the photoreceptor's electrical properties after prolonged exposure to room light.

In a further feature of the present invention there are provided imaging members containing a photogenerating pigment of Type V hydroxygallium phthalocyanine, especially with XRPD peaks at, for example, Bragg angles (2 theta +/−0.2°) of 7.4, 9.8, 12.4, 16.2, 17.6, 18.4, 21.9, 23.9, 25.0, 28.1, and the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in x-ray crystallographic measurements; (counts) represents the intensity of the diffraction as a function of Bragg angle as measured with a proportional counter.

In still a further feature of the present invention there are provided photoresponsive, or photoconductive imaging members, which can be selected for imaging processes including color xerography.

Aspects of the present invention relate to a photoconductive imaging member comprised of a supporting substrate, a photogenerating layer, a charge transport layer, and an overcoating layer, and wherein the overcoating layer is, for example, comprised of a polymer, such as LUCKAMIDE®, and a yellow dye wherein the overcoating layer substantially prevents undesirable light of, for example, a wavelength of about equal to or less than about 700 nanometers, such as from about 400 to about 500 nanometers from interaction with the photogenerating layer; a photoconductive member with a photogenerating layer of a thickness of from about 0.1 to about 10 microns, a transport layer of a thickness of from about 5 to about 100 microns; a photoconductive member wherein the dye component is present in an amount of from about 0.1 to about 5 weight percent; an imaging method and an imaging apparatus containing a charging component, a development component, a transfer component, and a fixing component, and wherein the apparatus contains a photoconductive imaging member comprised of a supporting substrate, and thereover a layer comprised of a photogenerator pigment and a charge transport layer, and thereover an overcoating layer containing the yellow dye illustrated herein; a photoconductive imaging member comprised of a supporting substrate, a photogenerating layer with a top overcoating layer containing a yellow dye component that prevents light of a wavelength of about equal to or about less than 700 nanometers from interaction with the photogenerating layer; a member wherein the photogenerating layer is of a thickness of from about 0.1 to about 10 microns, and the transport layer is of a thickness of from about 40 to about 75 microns; a member wherein the dye component is present in an amount of from about 0.1 to about 7 weight percent; a member wherein the photogeneratin layer contains a photogenerating pigment present in an amount of from about 5 to about 95 weight percent, and wherein the yellow dye component is present in an amount of from about 0.1 to about 1 weight percent; a member wherein the thickness of the photogenerator layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formulas; an imaging member wherein the photogenerator is a metal free phthalocyanine; an imaging member wherein the charge transport layer comprises

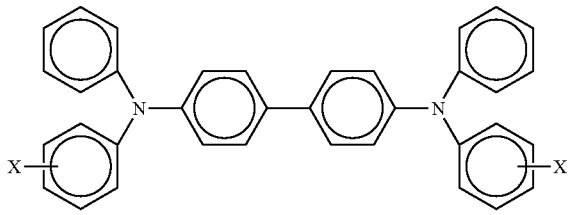

wherein X is selected from the group consisting of alkyl, alkoxy, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl; and wherein the resinous binder is selected from the group consisting of polycarbonates and polystyrene; an imaging member wherein the photogenerating pigment present in the photogenerating layer is comprised of Type V hydroxygallium phthalocyanine prepared by hydrolyzing a gallium phthalocyanine precursor by dissolving the hydroxygallium phthalocyanine in a strong acid and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; an imaging member wherein the dye component is present in an amount of from about 0.5 to about 0.9 weight percent and wherein the transport layer contains a resin binder; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; an imaging apparatus containing a charging component, a development component, a transfer component, and a fixing component, and wherein the apparatus contains a photoconductive imaging member comprised of a supporting substrate, and thereover a layer comprised of photogenerator pigments, a charge transport layer, and an overcoating protective layer containing a yellow dye as illustrated herein; a member comprised of a supporting substrate, a photogenerating layer, a charge transport layer, and an overcoating layer comprised of a polymer and a yellow dye as illustrated herein, and wherein the overcoating layer dye absorbs light of a wavelength of from about 400 to about 600 nanometers; a member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerator component amount is from about 0.05 weight percent to about 20 weight percent and wherein the photogenerating pigment is optionally dispersed in from about 10 weight percent to about 80 weight percent of a polymer binder; a member wherein the thickness of the photogenerating layer is from about 1 to about 12 microns; a member wherein the photogenerating and charge transport layer components are contained in a polymer binder; a member wherein the binder is present in an amount of from about 50 to about 90 percent by weight and wherein the total of the layer components is about 100 percent; an imaging member wherein the supporting substrate is comprised of a conductive substrate comprised of a metal; an imaging member wherein the conductive substrate is aluminum or aluminized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formulas; an imaging member wherein the photogenerating component is Type V hydroxygallium phthalocyanine, and the charge transport layer contains a hole transport of N,N'-diphenyl-N,N-bis(3-methyl phenyl)-1,1'-biphenyl-4,4'-diamine molecules, and wherein the hole transport resinous binder is selected from the group consisting of polycarbonates and polystyrene, and wherein the overcoating layer absorbs light in the region of from about 400 up to about 575 nanometers of light; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate and an adhesive layer coated on the blocking layer; an imaging member further containing an adhesive layer and a hole blocking layer; a color method of imaging which comprises generating an electrostatic latent image on the imaging member, developing the latent image, transferring and fixing the developed electrostatic image to a suitable substrate; photoconductive imaging members comprised of a supporting substrate, a photogenerating layer, a hole transport layer and a top overcoating layer in contact with the hole transport layer or in embodiments in contact with the photogenerating layer, and wherein the overcoating layer absorbs light of from about 400 to about 500 nanometers from penetrating to the charge generation and/or the hole transport layer, and in embodiments wherein a plurality of overcoatings, such as from two to about ten and more specifically two, may be selected; and a photoconductive imaging member comprised of an optional supporting substrate, a photogenerating layer, a charge transport layer, and an overcoating layer comprised of a polymer and a yellow dye, and wherein the yellow dye (Yellow Dye A) is of the formula

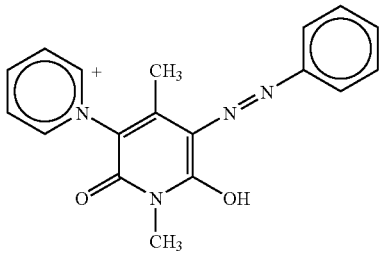

;

a member comprised of a photogenerating layer, a charge transport layer and in contact with the charge transport a layer comprised of a polymer and a dye of the formula

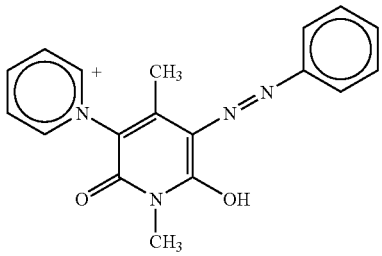

;

a member comprised of a photogenerating layer, a hole transport layer, and in contact with the hole transport a layer comprised of a polymer and a dye of the formula

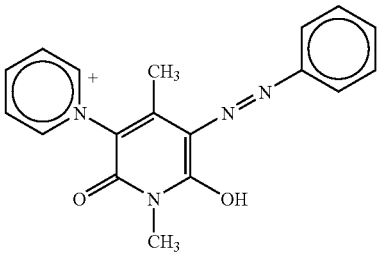

; and a member comprised of a supporting substrate, a photogenerating layer, a hole transport layer, and an overcoating layer comprised of a LUCKAMIDE® and a yellow dye, and which LUCKAMIDE® is of the formula as illustrated herein, and wherein the dye is of the formula

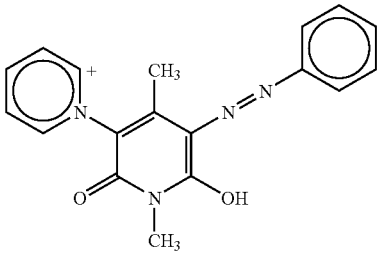

.

and wherein the overcoating layer absorbs light of a wavelength of from about 400 to about 600 nanometers.

Examples of photogenerating components are metal free phthalocyanines, metal phthalocyanines, perylenes, titanyl phthalocyanines, and more specifically, hydroxygallium phthalocyanine, alkoxygallium phthalocyanine, hydroxygallium dimers, vanadyl phthalocyanine, and chloroindium phthalocyanine. The photogenerating components are preferably dispersed in a suitable binder, such as polycarbonates, polyesters, polyvinybutyral, polysiloxanes and polyurethanes.

The overcoating layer is comprised of a polymer, and more specifically, a LUCKAMIDE®, commercially available, and a yellow dye, which dye can be present in in a suitable amount that absorbs the majority of the light of a wavelength of, for example, from about 400 to about 700 nanometers, and more specifically, from about 400 to about 500 or to about 460 nanometers. Specific examples of polymers for the overcoating top layer are methoxymethylated polyamides

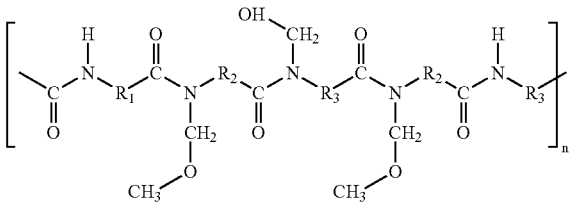

wherein $R_1$, $R_2$ and $R_3$ are the same or different and can be alkyl, and wherein n represents the number of segments, such as being a number of from about 50 to about 1,000; a LUCKAMIDE®, available from Dainippon Chemical Company, and encompassed by the above formula; and the like.

There may also be selected for the members of the present invention a suitable adhesive layer, preferably situated between the substrate and the generating layer, examples of adhesives being polyesters, such as VITEL® PE100 and PE200 available from Goodyear Chemicals, and especially MOR-ESTER 49,000® available from Norton International. The adhesive layer can be coated on to the supporting substrate from a suitable solvent, such as tetrahydrofuran and/or dichloromethane solution to enable a thickness thereof ranging, for example, from about 0.001 to about 5 microns, and more specifically, from about 0.1 to about 3 microns.

The photoconductive imaging members can be economically prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating components for the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 0.01 to about 30 microns after drying.

In embodiments of the present invention, it is desirable to select as the coating solvents ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Imaging members of the present invention are useful in various electrostatographic imaging and printing systems, particularly those conventionally known as xerographic processes. Specifically, the imaging members of the present invention can be selected for xerographic imaging processes wherein the photogenerating component like the Type V hydroxygallium phthalocyanine pigment absorbs light of a wavelength of from about 550 to about 950 nanometers, and preferably from about 700 to about 850 nanometers; moreover, the imaging members of the present invention can be selected for electronic printing processes with gallium arsenide diode lasers, light emitting diode (LED) arrays, which typically function at wavelengths of from about 660 to about 830 nanometers.

Examples of substrate layers selected for the imaging members of the present invention include opaque or substantially transparent components, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material with a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as, for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as, for example, polycarbonate materials commercially available as MAKROLON®. The thickness of the substrate layer depends on many factors, including economical considerations, thus this layer may be of substantial thickness, for example over 3,000, such as from about 3,000 to about 7,000 microns, or of a minimum thickness such as from about 75 microns to about 300 microns.

Known charge, especially hole, transport components can be selected for the charge transport layer including molecules of the following formula

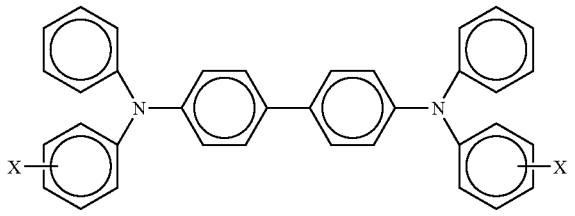

wherein X is alkyl, a halogen, or mixtures thereof, and especially Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport molecules can be selected, reference for example U.S. Pat. Nos. 4,921,773 and 4,464,450, the disclosures of which are totally incorporated herein by reference.

Polymer binder examples for the charge transport layer include components as illustrated, for example, in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000 with a molecular weight, preferably $M_W$ of from about 50,000 to about 100,000 being particularly preferred.

Also included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example, by heat the image thereto. In those environments wherein the member is to be used in a printing mode, the imaging method is similar with the exception that exposure can be accomplished with a laser device or image bar.

Light shock refers, for example, to a phenomena in which a photoresponsive imaging member when exposed to room light exhibits an increase in dark decay, depletion, increased sensitivity, collapse of the photoinduced discharge curve (PIDC) tail, and reduced residual potential $V_{residual}$. The exposure to room light may occur, for example, during installation of the photoreceptor or during servicing of a machine, such as a xerographic machine. Thus, for example, during belt replacement or machine maintenance, nonuniform exposure of the photoreceptor to room light can result in nonuniformity in the electrical properties of the imaging member. A difference in electrical properties between exposed areas of an imaging member is undesirable because it can cause nonuniform image potentials which can result in the formation of nonuniform toner images when the light shocked imaging member is subsequently utilized for electrophotographic imaging. The light shock problem can be particularly serious in imaging members containing phthalocyanine particles, such as hydroxygallium phthalocyanine or alkoxygallium phthalocyanine, as photogenerating pigments.

The following Examples are being submitted to illustrate embodiments of the present invention. These Examples are intended to be illustrative only and are not intended to limit the scope of the present invention. Also, temperatures are in degrees Centigrade, and parts and percentages are by weight unless otherwise indicated.

EXAMPLE I

Control

Layered photoconductive imaging members were prepared by the following procedure. A titanized MYLAR® substrate of 75 microns in thickness with a gamma amino propyl triethoxy silane layer, 0.1 micron in thickness, thereover, and E.I. DuPont 49,000 polyester adhesive thereon in a thickness of 0.1 micron was used as the base conductive film. A hydroxygallium phthalocyanine charge generation layer (CGL) was prepared as follows: 0.55 gram of HOGaPc (V) pigment was mixed with 0.58 gram of poly(styrene-b-4-vinylpyridine)polymer and 20 grams of toluene in a 60 milliliter glass bottle containing 70 grams of approximately 0.8 millimeter diameter glass beads. The bottle was placed in a paint shaker and shaken for 2 hours. The resultant pigment dispersion was coated using a #8 wire rod onto the titanized MYLAR® substrate of 75 microns in thickness, which had a gamma amino propyl triethoxy silane layer, 0.1 micron in thickness, thereover, and E.I. DuPont 49,000 polyester adhesive thereon in a thickness of 0.1 micron. Thereafter, the photogenerator layer formed was dried in a forced air oven at 100° C. for 10 minutes.

A transport layer solution was generated by mixing 10 grams of N,N'-diphenyl-N,N'-bis(3-methylphenyl)-1,1-biphenyl-4,4'-diamine (TPD), 10 grams of polycarbonate resin (available as MAKROLON® 5705 from Bayer A.G.), and 133 grams of methylene chloride. The mixture was stirred overnight, about 18 to about 20 hours, until a complete solution was obtained. The transport solution was then coated onto the above photogenerating layer using a Bird film applicator with a 4 mil gap. The resulting member was dried at 100° C. (degrees Centigrade) in a forced air oven for 30 minutes. The final dried thickness of the transport layer was about 28 microns.

The xerographic electrical properties of the above prepared photoconductive imaging member and other similar members can be determined by known means, including electrostatically charging the surfaces thereof with a corona discharge source until the surface potentials, as measured by a capacitively coupled probe attached to an electrometer, attained an initial value $V_o$ of about -800 volts. After resting for 0.5 second in the dark, the charged members attained a surface potential of $V_{ddp}$, dark development potential. Each member was then exposed to light from a filtered Xenon lamp thereby inducing a photodischarge which resulted in a reduction of surface potential to a $V_{bg}$ value, background potential. The percent of photodischarge was calculated as $100\times(V_{ddp}-V_{bg})V_{ddp}$. The desired wavelength and energy of the exposed light was determined by the type of filters placed in front of the lamp. The monochromatic light photosensitivity was determined using a narrow band-pass filter. The photosensitivity of the imaging member was usually provided in terms of the amount of exposure energy in ergs/cm$^2$, designated as $E_{1/2}$, required to achieve 50 percent photodischarge from $V_{ddp}$ to half of its initial value. The higher the photosensitivity, the smaller was the $E_{1/2}$ value. Another electrical property of the imaging member, designated as $E_{7/8}$, was the amount of exposure energy, in ergs/cm$^2$, required to achieve 87.5 percent or ⅞ discharge. This was equivalent to discharging an imaging member from about −800 volts to about −100 volts. The device was finally exposed to an erase lamp of appropriate light intensity and any residual potential ($V_{residual}$) was measured. The imaging members were tested with an exposure monochromatic light at a wavelength of 780 nanometers and an erase light with the wavelength of about 600 to about 800 nanometers. The imaging member had a dark decay of 24 volts/second, a $V_{residual}$ of −14 volts, an $E_{1/2}$ of 1.41 ergs/cm$^2$ and an $E_{7/8}$ of 3.24 ergs/cm$^2$.

EXAMPLE II

A hydroxygallium phthalocyanine (HOGaPc (V)) charge generator layer was prepared by repeating the processes of Example I. A transport layer solution was then generated by mixing 10 grams of N,N'-diphenyl-N,N'-bis(3-methylphenyl)-1,1-biphenyl-4,4'-diamine (TPD), 10 grams of polycarbonate resin (available as MAKROLON 5705® from Bayer A.G.), and 133 grams of methylene chloride. The solution was stirred overnight (about 18 to about 20 hours throughout) until a complete solution was obtained. The resulting transport solution was coated onto the above photogenerating layer using a Bird film applicator with a 4 mil gap.

The above transport layer was then overcoated with a mixture of 0.7 gram of a polyamide containing methoxymethyl groups (LUCKAMIDE® 5003 available from Dai Nippon Ink), 0.3 gram of ELVAMIDE® 8063 (available from E.I. DuPont), methanol (3.5 grams) and 1-propanol (3.5 grams) from a 2 ounce amber bottle and warmed with magnetic stirring in a water bath at about 60° C. A solution formed within 30 minutes. This solution was then allowed to cool to 25° C. Subsequently, 0.08 gram of oxalic acid was added and the mixture was warmed to 40° C. Thereafter, 0.9 gram of N,N'-diphenyl-N,N'-bis(3-hydroxyphenyl)-[1,1'-biphenyl]-4,4'-diamine (DHTPD) was added and stirred until a complete solution was formed. A separate solution containing 0.08 gram of CYMEL® 303 (hexamethoxymethylmelamine available from Cytec Industries Inc.) and 0.2 gram of bis(4-diethylamino-2-methylphenyl)-4-methoxyphenylmethane and 1 gram tetrahydrofuran was formed and added to the polymer solution. To the ressulting combined solution was added 0.012 gram (0.5 percent solids wt/wt.) of Yellow dye A illustrated herein, and the mixture resulting was agitated to obtain a complete solution.

The resulting member was dried at 100° C. in a forced air oven for 30 minutes. The final dried thickness of the transport layer was about 26 microns.

The electrical properties of the above generated member were measured in accordance with the procedure described in Example I. The imaging member had a dark decay of 26 volts/second, a $V_{residual}$ of −26 volts, an $E_{1/2}$ of 1.46 ergs/cm$^2$ and an $E_{7/8}$ of 3.46 ergs/cm$^2$.

EXAMPLE III

A hydroxygallium phthalocyanine (HOGaPc (V)) charge generator layer was prepared following the processes as described in Example I. A transport layer solution was then generated by mixing 10 grams of N,N'-diphenyl-N,N'-bis(3-methylphenyl)-1,1-biphenyl-4,4'-diamine (TPD), 10 grams of polycarbonate resin (available as MAKROLON® 5705 from Bayer A.G.), and 133 grams of methylene chloride. The resulting mixture was stirred overnight until a complete solution was obtained. The transport solution was coated onto the above photogenerating layer using a Bird film applicator with a 4 mil gap. The resulting member was dried at 100° C. in a forced air oven for 30 minutes.

The above transport layer was then overcoated with a mixture of 0.7 gram of a polyamide containing methoxymethyl groups (LUCKAMIDE® 5003 available from Dai Nippon Ink), 0.3 gram of ELVAMIDE® 8063 (available from E.I. DuPont), methanol (3.5 grams) and 1-propanol (3.5 grams) from a 2 ounce amber bottle and warmed with magnetic stirring in a water bath at about 60° C. A solution formed within 30 minutes. This solution was then allowed to cool to 25° C. Next, 0.08 gram of oxalic acid was added and the mixture was warmed to 40° C. Subsequently, 0.9 gram of N,N'-diphenyl-N,N'-bis(3-hydroxyphenyl)-[1,1'-biphenyl]-4,4'-diamine (DHTPD) was added and stirred until a complete solution was formed. A separate solution containing 0.08 gram of CYMEL® 303 (hexamethoxymethylmelamine available from the Cytec Industries Inc.), 0.2 gram of bis(4-diethylamino-2-methylphenyl)-4-methoxyphenylmethane and 1 gram of tetrahydrofuran was formed and added to the above polymer solution. To the combined solution there was added 0.06 gram (2.5 percent solids wt/wt.) of Yellow dye A, and the mixture resulting was agitated to obtain a complete solution. The solution was allowed to set overnight to insure suitable viscosity properties.

The resulting member was dried at 115° C. in a forced air oven for 60 minutes. The final dried thickness of the hole transport layer was about 30 microns.

The electrical properties of the above member were measured in accordance to the procedure described in Example I. The imaging member had a dark decay of 22 volts/second, a $V_{residual}$ of −30 volts, an $E_{1/2}$ of 1.49 ergs/cm$^2$ and an $E_{7/8}$ of 3.65 ergs/cm$^2$.

EXAMPLE IV

A hydroxygallium phthalocyanine (HOGaPc (V)) charge generator layer was prepared by following the processes as described in Example I. A hole transport layer solution was then generated by mixing 10 grams of N,N'-diphenyl-N,N'-bis(3-methylphenyl)-1,1-biphenyl-4,4'-diamine (TPD), 10 grams of polycarbonate resin (available as MAKROLON® 5705 from Bayer A.G.), and 133 grams of methylene chloride. The mixture resulting was stirred overnight until a complete solution was affected. The transport solution was coated onto the above photogenerating layer using a Bird film applicator with a 4 mil gap. The resulting member was dried at 100° C. in a forced air oven for 30 minutes.

The above transport layer was then overcoated with a mixture of 0.7 gram of a polyamide containing methoxymethyl groups (LUCKAMIDE® 5003 available from Dai Nippon Ink), 0.3 gram of ELVAMIDE® 8063 (available from E.I. DuPont), methanol (3.5 grams) and 1-propanol (3.5 grams) from a 2 ounce amber bottle and warmed with magnetic stirring in a water bath at about 60° C. A solution formed within 30 minutes. This solution was then allowed to cool to 25° C. Next, 0.08 gram of oxalic acid was added and the mixture was warmed to 40° C. Subsequently, 0.9 gram N,N'-diphenyl-N,N'-bis(3-hydroxyphenyl)-[1,1'-biphenyl]-4,4'-diamine (DHTPD) was added and stirred until a complete solution was formed. A separate solution containing 0.08 gram of CYMEL® 303 (hexamethoxymethylmelamine available from Cytec Industries Inc.), 0.2 gram of bis(4-diethylamino-2-methylphenyl)-4-methoxyphenylmethane and 1 gram of tetrahydrofuran was formed and added to the above polymer solution.

The resulting member was dried at 115° C. in a forced air oven for 60 minutes. The final dried thickness of the hole transport layer was about 25 microns.

The electrical properties of the above member were measured in accordance with the procedure described in Example I. The imaging member had a dark decay of 22 volts/second, a $V_{residual}$ of −35 volts, an $E_{1/2}$ of 1.46 ergs/cm$^2$ and an $E_{7/8}$ of 3.75 ergs/cm$^2$.

EXAMPLE V

A hydroxygallium phthalocyanine (HOGaPc (V)) charge generator layer was prepared by following the processes as described in Example I. A hole transport layer solution was then generated by mixing 10 grams of N,N'-diphenyl-N,N'-bis(3-methylphenyl)-1,1-biphenyl-4,4'-diamine (TPD), 10 grams of polycarbonate resin (available as MAKROLON® 5705 from Bayer A.G.), and 133 grams of methylene chloride. The solution was placed on a paint shaker and shaken for about 4 to about 5 hours. The hole transport solution was coated onto the above photogenerating layer using a film applicator of a 10 mil gap.

The above transport layer was then overcoated with a mixture of LUCKAMIDE® obtained from and selected in accordance with Example III. The resulting member was dried at 115° C. in a forced air oven for 60 minutes. The final dried thickness of the hole transport layer was about 25 microns.

The electrical properties of the above resulting photoconductive member were measured in accordance with the procedure described in Example I. The imaging member had a dark decay of 30 volts/second, a $V_{residual}$ of −10 volts, an $E_{1/2}$ of 1.30 ergs/cm$^2$ and an $E_{7/8}$ of 3.23 ergs/cm$^2$.

EXAMPLE VI

A hydroxygallium phthalocyanine (HOGaPc (V)) charge generator layer was prepared by following the processes as described in Example I. A transport layer solution was then generated by mixing 10 grams of N,N'-diphenyl-N,N'-bis(3-methylphenyl)-1,1-biphenyl-4,4'-diamine (TPD), 10 grams of polycarbonate resin (available as MAKROLON® 5705 from Bayer A.G.), and 137 grams of methylene chloride. The solution was placed on a paint shaker and shaken for about 4 to about 5 hours. The transport solution was coated onto the above photogenerating layer using a film applicator of 10 mil gap.

The above transport layer was then overcoated in accordance with Example III. The resulting member was dried at 125° C. in a forced air oven for 50 minutes. The final dried thickness of the transport layer was about 23 microns.

The electrical properties of the above member were measured in accordance with the procedure described in Example I. The imaging member had a dark decay of 24 volts/second, a $V_{residual}$ of −61 volts, an $E_{1/2}$ of 1.33 ergs/cm$^2$ and an $E_{7/8}$ of 3.92 ergs/cm$^2$.

EXAMPLE VII

Light Shock Measurement:

The degree of light shocking of each of the imaging members of Examples I, II, III, IV, V, VI were measured in a xerographic scanner by recording the photodischarge properties before and after subjecting them to 1,000,000 ergs/cm$^2$ of light of wavelength between 400 nanometers to 500 nanometers. An imaging member with minimal resistance to light shock will exhibit a change in photodischarge properties after light shocking. An imaging member which exhibits light shock resistance will possess similar photodischarge properties before and after light shocking. Some of the pertinent electrical properties to observe are dark decay, $V_{residual}$, $E_{1/2}$ and $E_{7/8}$. The electrical properties of the imaging member of the above Examples I, II, III, IV, V, VI before and after light shocking are provided in Table 1, Table 2, Table 3 and Table 4, with the device or member of Example I representing a control device with minimal light shock resistance.

TABLE 1

| Dark Decay (V/sec) | | | |
|---|---|---|---|
| Device | Before Light Shock | After Light Shock | Percent Change |
| Control Device from Example I | 24 | 34 | 42 |
| Device of Example II with 0.1 weight percent of Yellow Dye | 26 | 32 | 23 |
| Device of Example III with 0.5 weight percent of Yellow Dye | 22 | 28 | 27 |
| Device of Example IV with 1 weight percent of Yellow Dye | 22 | 26 | 18 |
| Device of Example V with 1 weight percent of Yellow Dye | 30 | 42 | 40 |
| Device of Example VI with 1 weight percent of Yellow Dye | 24 | 32 | 33 |

TABLE 2

| $V_{residual}$ | | | |
|---|---|---|---|
| Device | Before Light Shock | After Light Shock | Percent Change |
| Control Device from Example I | −14 | −2 | 85 |
| Device of Example II with 0.1 weight percent of Yellow Dye | −26 | −12 | 54 |
| Device of Example III with 0.5 weight percent of Yellow Dye | −30 | −22 | 27 |
| Device of Example IV with 1 weight percent of Yellow Dye | −35 | −27 | 23 |
| Device of Example V with 1 weight percent of Yellow Dye | −10 | −9 | 10 |
| Device of Example VI with 1 weight percent of Yellow Dye | −61 | −41 | 34 |

TABLE 3

| $E_{1/2}$ | | | |
|---|---|---|---|
| Device | Before Light Shock | After Light Shock | Percent Change |
| Control Device from Example I | 1.41 | 1.30 | 8 |
| Device of Example II with 0.1 weight percent of Yellow Dye | 1.46 | 1.39 | 5 |
| Device of Example III with 0.5 weight percent of Yellow Dye | 1.49 | 1.41 | 5 |
| Device of Example IV with 1 weight percent of Yellow Dye | 1.46 | 1.42 | 3 |
| Device of Example V with 1 weight percent of Yellow Dye | 1.30 | 1.26 | 3 |
| Device of Example VI with 1 weight percent of Yellow Dye | 1.33 | 1.25 | 6 |

TABLE 4

| $E_{7/8}$ | | | |
|---|---|---|---|
| Device | Before Light Shock | After Light Shock | Percent Change |
| Control Device from Example I | 3.24 | 2.59 | 20 |
| Device of Example II with 0.1 weight percent of Yellow Dye | 3.46 | 3.04 | 12 |
| Device of Example III with 0.5 percent weight of Yellow Dye | 3.65 | 3.35 | 9 |
| Device of Example IV with 1 weight percent of Yellow Dye | 3.75 | 3.35 | 11 |
| Device of Example V with 1 weight percent of Yellow Dye | 3.23 | 2.85 | 12 |
| Device of Example VI with 1 weight percent of Yellow Dye | 3.92 | 2.96 | 25 |

The resistance to light shock was observable as a reduction in the difference of the electrical properties before and after light shocking when compared to the control imaging member of Example I. The imaging members described in Examples II to VI exhibit varying degrees of light shock resistance. This resistance to light shock is particularly evident in the change in $V_{residual}$ before and after light shocking.

EXAMPLE VIII

Xerographic cycling tests were also performed by continuously charging, exposing and erasing the imaging members. The residual voltage of the imaging members described in Example II, Example III and Example IV were recorded to cycle-up. The amount of cycle-up in these Examples was somewhat proportional to, for example, the amount of LUCKAMIDE® and yellow dye present in the imaging member. The imaging member described in Example III possessed similar light resistance as compared to the imaging member described in Example IV, but the member of Example III possessed more favorable residual voltage cycling stability (less cycle-up).

EXAMPLE IX

Layered photoconductive imaging members were prepared by the following procedure. A titanized MYLAR® substrate of 75 microns in thickness, which had a gamma amino propyl triethoxy silane layer, 0.1 micron in thickness, thereover, and E.I. DuPont 49,000 polyester adhesive thereon in a thickness of 0.1 micron was used as the base conductive film. The next coating applied was a charge generator layer containing 2.8 percent by weight of hydroxygallium phthalocyanine particles dispersed in 2.8 percent by weight of poly(4,4-diphenyl-1,1-cyclohexene carbonate) (PCZ-200, available from Mitsubishi Gas) having an optical density of 0.95 (a dried thickness of about 0.4 micrometer).

A hole transport layer solution was then generated by mixing 10 grams of N,N'-diphenyl-N,N'-bis(3-methylphenyl)-1,1-biphenyl-4,4'-diamine (TPD), 10 grams of polycarbonate resin (available as MAKROLON 5705® from Bayer A.G.), and 133 grams of methylene chloride. The solution was placed on a paint shaker and shaken for about 4 to about 5 hours. The transport solution was coated onto the above photogenerating layer using a film applicator of 10 mil gap.

The above transport layer was then overcoated by the process of Example III. The resulting member was dried at 135° C. in a forced air oven for 50 minutes. The final dried thickness of the transport layer was about 23 microns.

The electrical properties of the above prepared photoconductive member was measured in accordance with the procedure described in Example I. The imaging member had a dark decay of 36 volts/second, a $V_{residual}$ of −27 volts, an $E_{1/2}$ of 1.20 ergs/cm$^2$ and an $E_{7/8}$ of 2.99 ergs/cm$^2$.

EXAMPLE X

A hydroxygallium phthalocyanine (HOGaPc (V)) charge generator layer was prepared following the processes as described in Example IX. A transport layer solution was then generated by mixing 10 grams of N,N'-diphenyl-N,N'-bis (3-methylphenyl)-1,1-biphenyl-4,4'-diamine (TPD), 10 grams of the polycarbonate resin (available as MAKROLON 5705® from Bayer A.G.), and 133 grams of methylene chloride. The solution resulting was placed on a paint shaker and shaken for about 4 to about 5 hours, and was coated onto the above photogenerating layer using a film applicator of 10 mil gap.

The above transport layer was then overcoated by the process of Example III. The resulting member was dried at 135° C. in a forced air oven for 45 minutes. The final dried thickness of the transport layer was about 27 microns.

The electrical properties of the photoconductor member were measured in accordance with the procedure described in Example I. The imaging member had a dark decay of 38 volts/second, a $V_{residual}$ of −22 volts, an $E_{1/2}$ of 1.27 ergs/cm$^2$ and an $E_{7/8}$ of 3.04 ergs/cm$^2$.

EXAMPLE XI

Light Shock Measurement:

The degree of light shocking of the imaging members of Examples IX and X were measured in accordance with the procedure described in Example VII. An imaging member which exhibits substantial light shock resistance will possess similar photodischarge properties before and after light shocking. Some of the pertinent electrical properties to observe are dark decay, $V_{residual}$, $E_{1/2}$ and $E_{7/8}$. The electrical properties of the imaging member of Examples IX and X before and after light shocking are given in Table 5, Table 6, Table 7 and Table 8.

TABLE 5

| Device | Dark Decay (V/sec) Before Light Shock | After Light Shock | Percent Change |
|---|---|---|---|
| Control Device from Example IX | 36 | 50 | 39 |
| Device of Example X with 1 weight percent of Yellow Dye | 38 | 44 | 16 |

TABLE 6

| Device | $V_{residual}$ Before Light Shock | After Light Shock | Percent Change |
|---|---|---|---|
| Control Device from Example I | 27 | 8 | 70 |
| Device of Example X with 1 weight percent of Yellow Dye | 22 | 18 | 18 |

TABLE 7

| Device | $E_{1/2}$ Before Light Shock | After Light Shock | Percent Change |
|---|---|---|---|
| Control Device from Example I | 1.20 | 1.15 | 4 |
| Device of Example X with 1 weight percent of Yellow Dye | 1.27 | 1.26 | 1 |

TABLE 8

| Device | $E_{7/8}$ Before Light Shock | After Light Shock | Percent Change |
|---|---|---|---|
| Control Device from Example I | 2.99 | 2.55 | 15 |
| Device of Example X with 1 weight percent of Yellow Dye | 3.04 | 2.98 | 2 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive imaging member comprised of an optional supporting substrate, a photogenerating layer, a charge transport layer, and an overcoating layer comprised of a polymer and a yellow dye, and wherein said yellow dye is of the formula

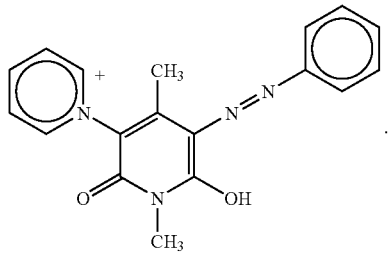

2. An imaging member in accordance with claim 1 wherein said photogenerating layer is of a thickness of from about 0.1 to about 10 microns, said transport layer is of a thickness of from about 5 to about 100 microns, and wherein the amount of light contacting said photogenerating and said charge transport layers is substantially avoided.

3. An imaging member in accordance with claim 1 wherein said overcoating layer substantially prevents light of a wavelength of about equal to or about less than 700 nanometers from interaction with said member, and wherein said overcoating optionally contains N,N'-diphenyl-N,N'-bis(3-hydroxyphenyl)-[1,1'-biphenyl]-4,4'-diamine (DHTPD), oxalic acid, and bis(4-diethylamino-2-methylphenyl)-4-methoxyphenylmethane [tris-TPM]methoxymethylated polyamide of Formula III, or mixtures thereof

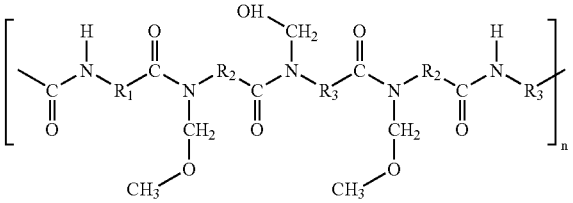

wherein $R_1$, $R_2$ and $R_3$ are alkyl, and wherein n represents the number of repeating segments, and optionally is a number of from about 50 to about 1,000.

4. An imaging member in accordance with claim 3 wherein the photogenerating layer contains a photogenerating pigment present in an amount of from about 5 to about 95 weight percent, and wherein said overcoating layer substantially prevents light of a wavelength of about equal to or about less than 700 nanometers from interaction with said member.

5. An imaging member in accordance with claim 4 wherein the thickness of said photogenerator layer is from about 0.1 to about 5 microns.

6. An imaging member in accordance with claim 1 wherein said photogenerating layer contains a polymer binder.

7. An imaging member in accordance with claim 6 wherein said binder is present in an amount of from about 50 to about 90 percent by weight, and wherein the total of all of said layer components is about 100 percent.

8. An imaging member in accordance with claim 1 wherein the photogenerating component is a hydroxygallium phthalocyanine that absorbs light of a wavelength of from about 370 to about 950 nanometers.

9. An imaging member in accordance with claim 1 wherein the supporting substrate is comprised of a conductive substrate comprised of a metal.

10. An imaging member in accordance with claim 1 wherein said photogenerator is a metal free phthalocyanine, and wherein said overcoating layer substantially prevents light of a wavelength of about equal to or less than about 700 nanometers from interaction with said member.

11. An imaging member in accordance with claim 1 wherein said charge transport comprises

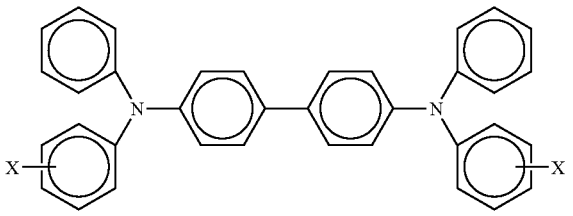

wherein X is selected from the group consisting of alkyl, alkoxy, and halogen.

12. An imaging member in accordance with claim 1 wherein said yellow dye absorbs light of a wavelength of from about 400 to about 460 nanometers, and wherein this absorption enables the avoidance or minimization of light shock to said photogenerating and said charge transport layers.

13. An imaging member in accordance with claim 1 wherein said photogenerating layer is comprised of Type V hydroxygallium phthalocyanine.

14. An imaging member in accordance with claim 13 wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees.

15. An imaging member in accordance with claim 1 wherein said supporting substrate is present, said photogenerating layer is in contact with said substrate, and said charge transport layer is in contact with said photogenerating layer.

16. A method of imaging which comprises generating an electrostatic latent image on the imaging member of claim 1, developing the latent image, and transferring the developed electrostatic image to a suitable substrate, and wherein said overcoating layer substantially prevents light of a wavelength of about equal to or about less than 700 nanometers from interaction with said member.

17. A member comprised of a photogenerating layer, a charge transport layer and in contact with said charge transport a layer comprised of a polymer and a yellow dye of the formula

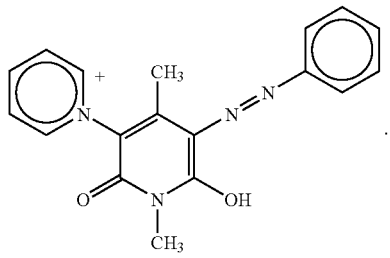

18. A member comprised of a supporting substrate, a photogenerating layer, a hole transport layer, and an overcoating layer comprised of a polymer and a yellow dye, and which polymer is of the formula

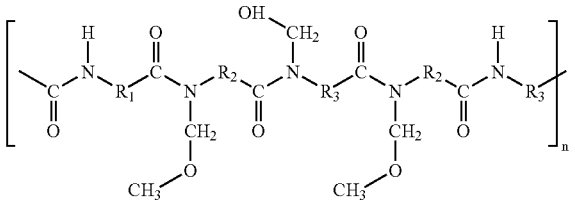

wherein $R_1$, $R_2$ and $R_3$ are alkyl, and wherein n represents the number of repeating segments, and optionally is a number of from about 50 to about 1,000; and wherein said dye is of the formula

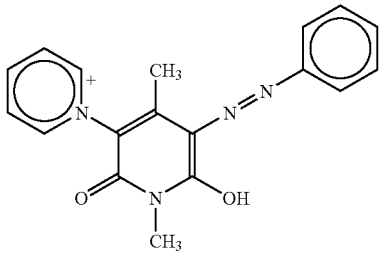
and wherein said overcoating layer absorbs light of a wavelength of from about optionally 400 to about 600 nanometers.
19. An imaging member in accordance with claim 1 wherein said polymer comprises a polyamide containing alkoxy groups.
20. An imaging member in accordance with claim 19 wherein said alkoxy is methoxymethyl.
* * * * *